United States Patent [19]

Pazicni

[11] Patent Number: 4,798,402

[45] Date of Patent: Jan. 17, 1989

[54] PRIORITY PLANNER CALENDAR

[76] Inventor: Joseph M. Pazicni, 105 Forliview Rd., Pittsburgh, Pa. 15116

[21] Appl. No.: 899,238

[22] Filed: Aug. 22, 1986

[51] Int. Cl.[4] ..... G09D 3/04; B42D 5/04

[52] U.S. Cl. ..... 283/2; 40/119

[58] Field of Search ..... 283/1, 2, 3; 282/3 B, 282/8 B, 9 A, 1 R; 40/107, 110, 113, 119, 121, 358; D19/20

[56] References Cited

U.S. PATENT DOCUMENTS

| | | | |
|---|---|---|---|
| 1,536,429 | 5/1925 | Ferdon | 283/2 |
| 1,810,440 | 6/1931 | Shedd | 40/119 |
| 1,921,815 | 8/1933 | Gibbs | 40/119 |
| 2,027,286 | 1/1936 | Pendergast | 283/2 |
| 2,393,809 | 1/1946 | Potter | 283/2 |
| 4,232,462 | 11/1980 | Longenecker | 40/119 |
| 4,488,366 | 12/1984 | Hockensmith | 40/119 |

FOREIGN PATENT DOCUMENTS

| | | | |
|---|---|---|---|
| 453606 | 12/1948 | Canada | 283/2 |

*Primary Examiner*—Paul A. Bell

*Assistant Examiner*—Paul M. Heyrana

*Attorney, Agent, or Firm*—Webb, Burden Ziesenheim & Webb

[57] ABSTRACT

A calendar having double length leaves is disclosed. Each double length leaf displays the second of two consecutive months (or other units of calendar time). The month takes up only half of the double length leaf or, in other words, the month occupies a space approximately defined by a single length of any given double length leaf. Each of the double length leaves functions, as a result, to refold and/or reposition in order to display its second of two consecutive months as the first of the next pair of consecutive months with any and all original scheduling notations preserved. Chronologic order of the two consecutive months visible is displayed from top to bottom. The double length leaf may, at the outset, be displayed full length and then be folded in half and up into its second position, or the double length leaf may begin in a folded-double position and be pulled up to its full length thereafter. The double length leaves are always folded along their widths at a line defined, approximately, by half the double length.

6 Claims, 3 Drawing Sheets

PRIORITY PLANNER CALENDAR

FIELD OF THE INVENTION

The present invention relates to bound planner calendars which, for optimal convenience and efficiency in scheduling, display two consecutive months, in order, at any given time.

INTRODUCTION

Limitless varieties of wall calendars are available for home or office use, but the vast majority of them display one calendar month at a time, in combination with a graphic, or pictorial, decorative or commercial display. Inherent in such calendars are obvious disadvantages, the primary disadvantage being the visibility of only one month at a time. If a wall calendar is used in week-to-week and month-to-month scheduling, the user must move close enough to the calendar to be able to turn the page to the desired month, and must hold the page(s) in position while making scheduling notations, etc.

Possibly as a direct result of this inherent disadvantage, certain handheld, desk-top or wall-mounted calendars which display days, weeks or months in combination, have been developed. A number of these calendars and time planners form the subject matter of issued United States patents. Exemplary of these patents is U.S. Pat. No. 669,319 to Dailey. The Dailey calendar is a folded paper calendar in which the months can be pulled down in order to expose two or more months of interest. Conceivably, although perforations allow the months to be torn off as desired, the months could be left in place and a long, unfolded and reverse-chronologic calendar would result.

Other issued United States patents disclose various other features. U.S. Pat. No. 1,207,987 to Oehler discloses a calendar, for business or social groups which assemble regularly, that is arranged so that a symbol such as "meeting" shows through the overlaying perforate pages regardless of the month. U.S. Pat. No. Re. 22,839 (originally U.S. Pat. No. 2,393,809) relates to calendars which can be made of a single strip of lightweight paper that can be automatically printed, folded and punched and which do not require further structural elements or assembly steps. U.S. Pat. No. 2,943,778 to Paulsen discloses a depository calendar having detachable envelopes for money or memoranda. U.S. Pat. No. 3,883,971 to Weiss discloses a year-at-a-glance memo calendar having accordian-folded months therein. The front and back covers of the memo calendar contain identical accordian-folded months so that any selected pair of months may be made visible between the covers. Original notations made on any given month are not preserved, however, when that same month is then reselected from the opposite side of the calendar.

Prior to the development of the present invention, none of the prior art wall calendars or other planning calendars provided a configuration which could display two consecutive months in chronologic order and preserve notations made on the page of any given month regardless of subsequent refolding or repositioning of the device. A need remains for a calendar which fulfills each of these functions and yet which may be manufactured easily and at low cost.

BRIEF DESCRIPTION OF THE INVENTION

In order to meet this need, the present invention is a calendar having double length leaves. Each double length leaf displays the second of two consecutive months (or other units of calendar time). The month takes up only half of the double length leaf or, in other words, the month occupies a space approximately defined by a single length of any given double length leaf. Each of the double length leaves functions, as a result, to refold and/or reposition in order to display its second of two consecutive months as the first of the next pair of consecutive months with any and all original scheduling notations preserved. Chronologic order of the two consecutive months visible is displayed from top to bottom. The double length leaf may, at the outset, be displayed full length and then be folded in half and up into its second position, or the double length leaf may begin in a folded-double position and be pulled up to its full length thereafter. The double length leaves are always folded along their widths at a line defined, approximately, by half the double length.

DETAILED DESCRIPTION OF THE INVENTION

Generally speaking, the present invention consists of the use of double length leaves having calendar months displayed on one half thereof which can, as a result of their double length, refold into a second configuration and position so as to continue to display not only the month pictured thereon but also the next consecutive month, with the two being in chronologic order. A first embodiment of this invention appears in FIG. 1.

Figure 1:
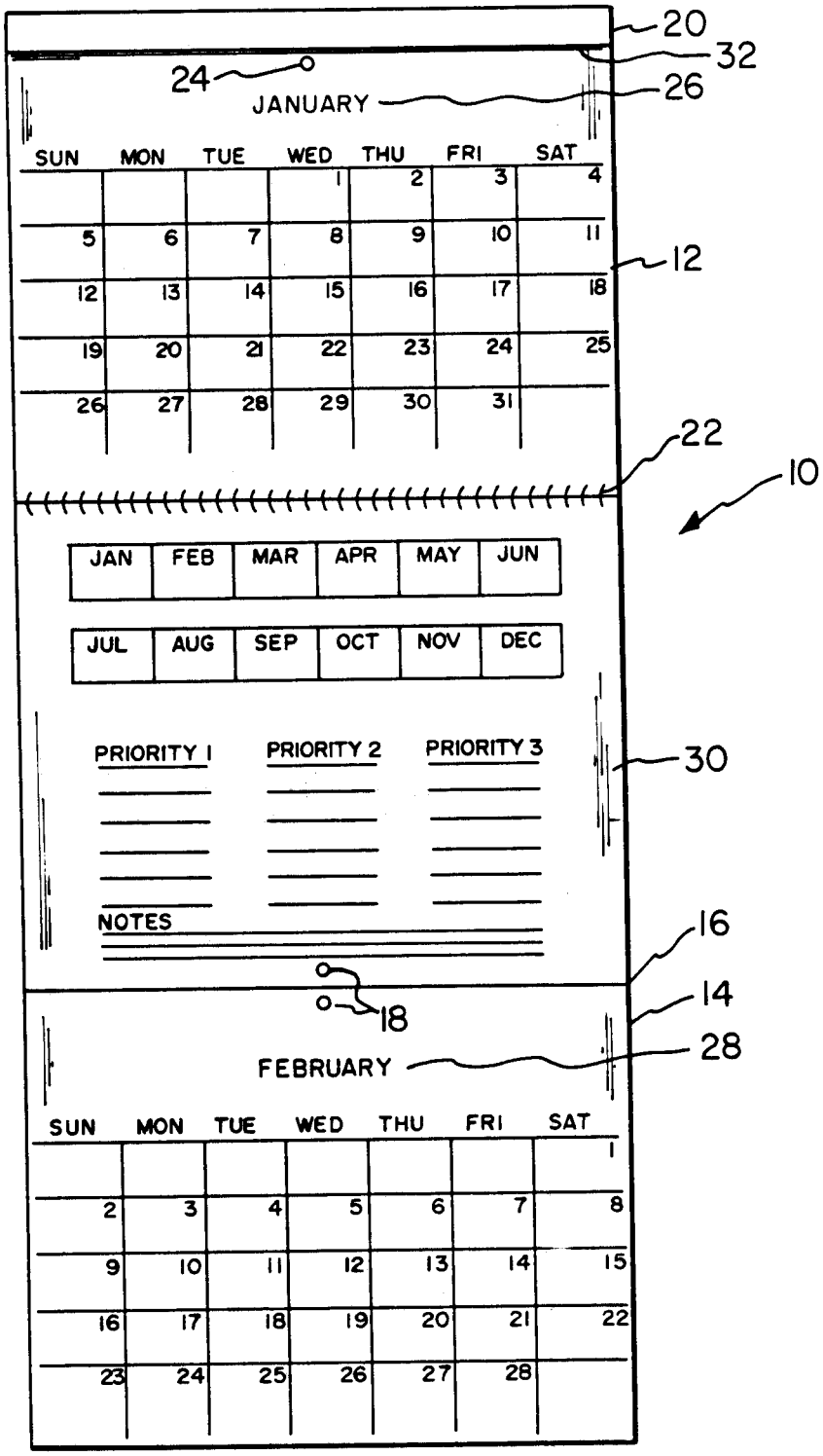
FIG. 1 discloses a side elevational view of the first embodiment of the priority planner calendar.

Referring now to FIG. 1, the priority planner calendar 10 comprises a single length leaf 12 and a double length leaf 14 connected by interleaf binding 22. (The single length leaf 12 as shown has approximately half the length of the double length leaf 14; the single length leaf may also be a double length leaf folded to a single length configuration.) The first consecutive month 26 is depicted on the single length leaf 12; the second consecutive month 28 appears on the lower half of the double length leaf 14. Each of the remaining 10 consecutive months appears on the lower half of further double length leaves (not shown), which are bound beneath the double length leaf 14. Visible just above the single length leaf 12 is the calendar backing support 20; the calendar 10 has a hanging means 24 (an aperture). The top half of the double length leaf 14, above the double length leaf crease 16, is the priority planning space 30, which may contain any and all kinds of planning and scheduling aids including a miniaturized calendar for the year, pictorial and or graphic displays and all manner of appliques, envelopes, pouches, pockets or other accessories which will not significantly inhibit the folding of the calendar 10 as a whole.

Figure 3:
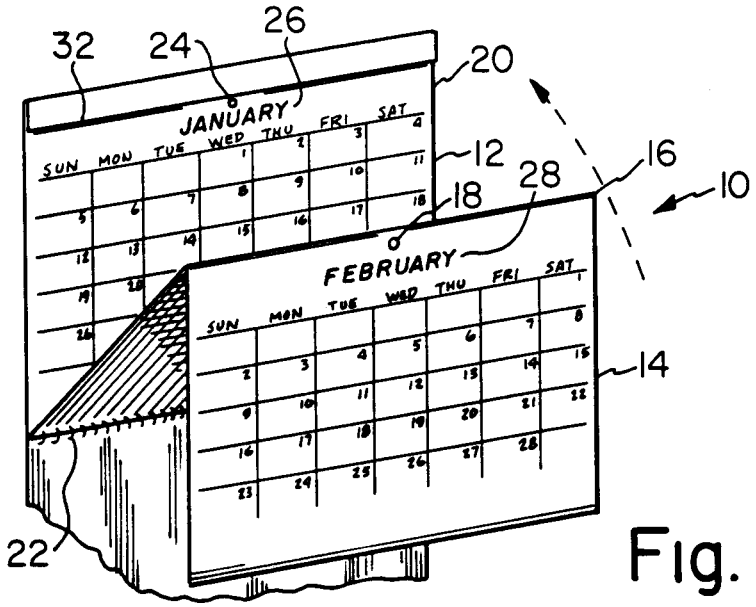
FIG. 3 is a perspective view of the embodiment illustrated in FIG. 1.

The operation of the first embodiment of the calendar 10 of FIG. 1 is illustrated in FIG. 3. In order to convert the calendar 10 from a configuration which displays the first two consecutive months 26 and 28, the user folds the double length leaf 14 along the double length leaf crease 16 and rotates the newly-folded-double length leaf 14 at the axis defined by the interleaf binding 22. The folded-double length leaf may be secured in its new position both by aligning the double length leaf crease apertures 18 with the hanging means 24 (supported on a nail or other wall projection (not shown)) and also by the optional insertion of the entire folded edge defined by the double length leaf crease 16 into the double length leaf attachment means 32 which, as illustrated, is a lip which opens at its lower edge and forms a part of the calendar backing support 20. Other leaf-affixing means are suitable for use and may be ascertained from the calendar arts. This folding and repositioning of the double length leaf reveals a third consecutive month (not shown) and the second and third months visible become the new set of "two consecutive months," visible in chronologic order. The original annotations made on the second consecutive month 28 are preserved after the double length leaf 14 which displays the second consecutive month 28 is reconfigured into its new position.

Notably, for reasons which will become more clear below, the priority planner calendar 10 of FIGS. 1 and 3 is a collection of leaves, ordinarily containing a plurality of double length leaves, in which the double length leaves have an initial position whereby they are fully extended and have a subsequent position whereby they are folded and attached along a horizontal line coplanar with the initial plane of the extended double length leaf.

Figure 2:
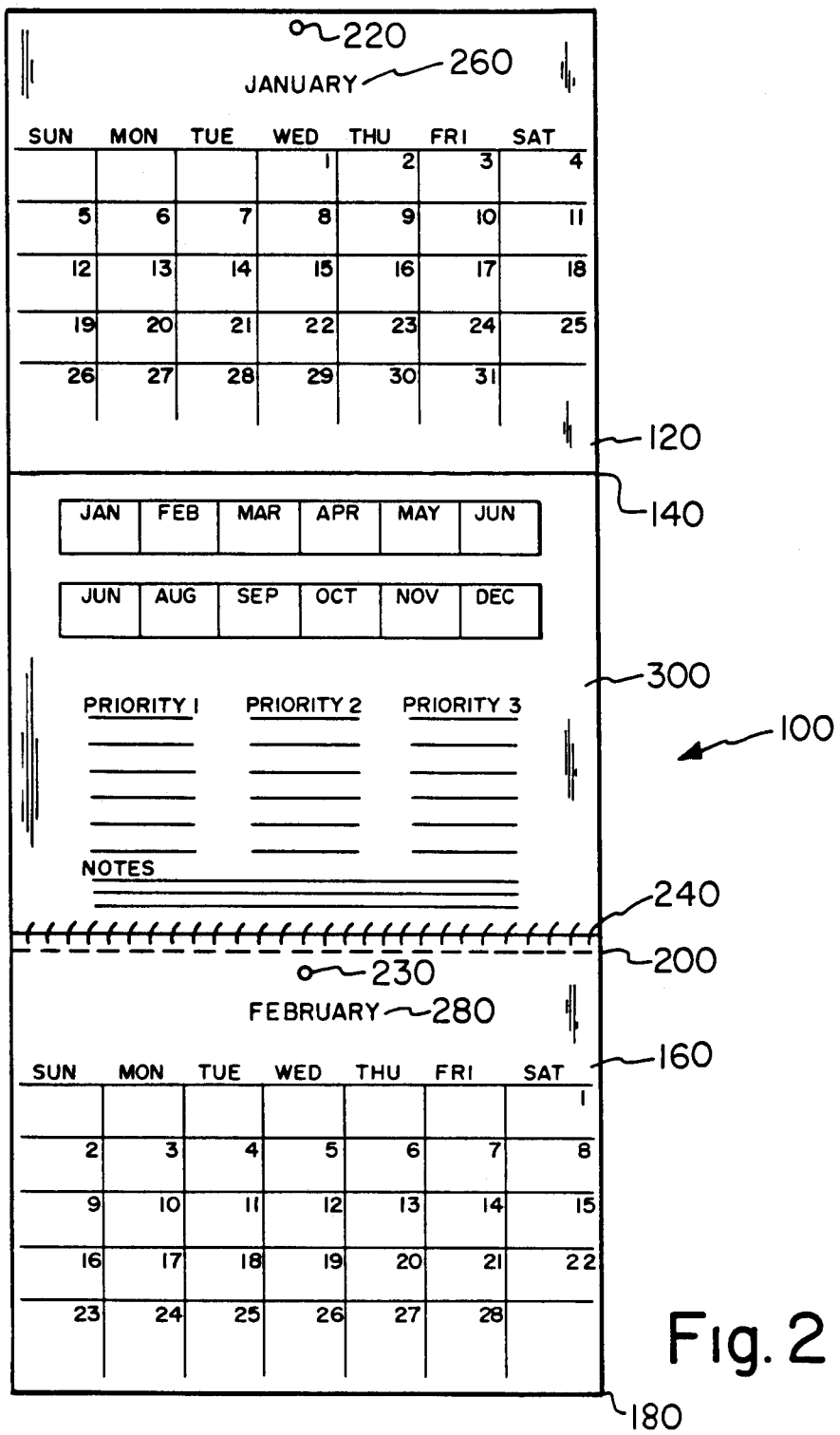
FIG. 2 discloses a side elevational view of a second embodiment of the priority planner calendar.

The second embodiment of the invention is illustrated in FIG. 2. The second embodiment of the priority planner calendar 100 comprises a first double length leaf 120 and a second double length leaf 160, each of which bears, respectively, the first double length leaf crease 140 and the second double length leaf crease 180. Note that the second double length leaf 160 is folded in half as shown in FIG. 2 with crease 180 appearing at the bottom of the illustration. The first and second double length leaves 120, 160, have therein the first and second double length leaf apertures 220, 230. The first and second double length leaves are bound at the interleaf binding 240. The second double length leaf 160, as shown in FIG. 2, is folded halfway down its length at the second double length leaf crease 180 so that it is attached to the interleaf binding 240 at both its short sides. At a small distance away from the interleaf binding 240, a line of perforations 200 extends parallel to the interleaf binding 240 near the top of the second double length leaf 160; the lowermost edge of said leaf contains no such perforations. The first double length leaf 120 displays the first consecutive month 260; the second double length leaf 160 displays the second consecutive month 280. Further folded-double length leaves (not shown) are bound to the interleaf binding 240 beneath the second double length leaf 160.

Figure 4:
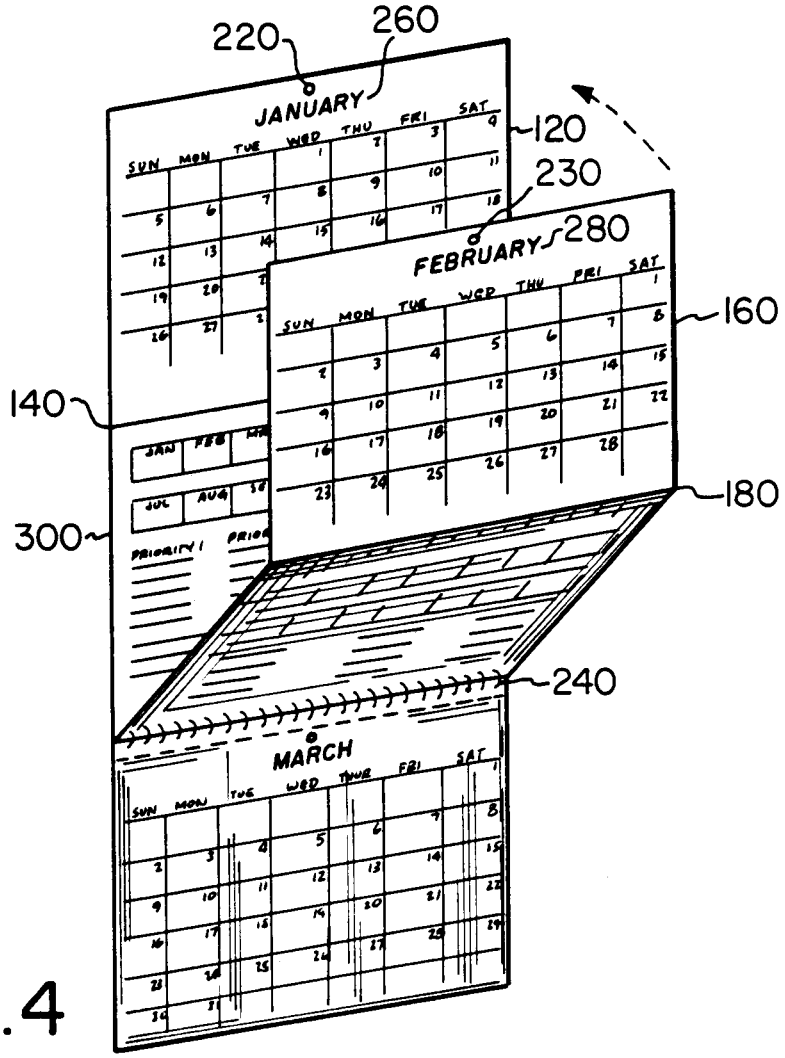
FIG. 4 is a perspective view of the embodiment of the invention illustrated in FIG. 2.

The operation of the second embodiment of the invention as illustrated in FIG. 2 appears in FIG. 4. When the user desires to reposition the second consecutive month to its position at the top of the priority planner calendar 100, the user tears the second double length leaf 160 along the line of perforations 200. (The line of perforations 200 is visible, however, only in FIG. 2.) The perforated edge of the second double length leaf 160 is then pulled upward, allowing rotation along the interleaf binding 240, and the second double length leaf 160 is affixed in its new position by, for example, the co-threading of the second double length leaf apertures 230 onto the nail or other projection available on the wall (not shown); the second consecutive month 280 thus becomes the first of a new pair of consecutive months, original notations on the second consecutive month 280 are maintained, and the visible months appear in chronologic order from top to bottom no matter which two months are displayed at any given time.

By analogy to the first embodiment of the invention, in which a free-hanging and extending double length leaf was folded and fastened along one edge at the time of its repositioning, the second embodiment of the invention provides an initially folded, double length leaf, which, for repositioning, is then extended to its full length. Thus, the first and second embodiments of the invention represent substantially similar double length leaf-and-folding phenomenon which is an essential aspect of the subject matter of this specification.

Referring now to FIGS. 1–4, numerous changes may be made to the individual features of the calendar device as shown without altering the basic concept of the invention. For example, the first and second consecutive months may in each case be replaced by half months, weeks or other portions of the calendar year. The line of perforations 200 may be replaced by other suitable, detachable fastening means which retain the second double length leaf in its folded configuration until repositioning is desired. The interleaf bindings 22 and 240 need not resemble the spiral binder as illustrated but may be any interleaf binding known in the book binding and printing arts. The hanging means 24 and the apertures 18, 220 and 230 may be replaced with hanging and leaf-affixing means known in the calendar arts. The double length leaf attachment means 32 of FIGS. 1 and 3, which constitutes a lip of the calendar backing support 20, may be replaced by other leaf-edge securing means known in the calendar and printing arts. As discussed above, the priority planning spaces 30 and 300 may contain any and all types of pictorial, graphic or structural displays as long as the calendar of the present invention may still fold for use.

Although the invention has been described with reference to specific materials and specific processes, the invention is to be limited only insofar as is set forth in the accompanying claims.

I claim:

1. A calendar comprising a bound collection of leaves containing a plurality of double length leaves, each double length leaf having a display of an entire calendar month contained within one-half the surface area thereof, each double length leaf being attached at one of its ends to an interleaf binding, each double length leaf being, in a first position thereof, detachably attached at the other of its ends to said interleaf binding wherein said double length leaf is folded in half, whereby each double length leaf may be repositioned, from said first position to a second position, in which second position each double length leaf is attached to said interleaf binding by only one of its ends and in which second position each double length leaf is positioned above said interleaf binding in an unfolded position, and further whereby the same display of said entire calendar month remains visible in entirety when said double length leaf is positioned in either said first position or said second position.

2. The calendar according to claim 1 wherein the calendar contains at least eleven double length leaves.

3. The calendar according to claim 1 wherein the calendar contains at least twelve double length leaves.

4. The calendar according to claim 1 wherein the calendar further contains leaf-affixing means thereon.

5. The calendar according to claim 4 wherein said leaf-affixing means are apertures located in one or more leaves thereof.

6. The calendar according to claim 1 wherein at least one of said double length leaves has a priority planning space thereon.

* * * * *